United States Patent [19]

Kurzius

[11] 4,299,366

[45] Nov. 10, 1981

[54] CAN HOLDER

[76] Inventor: Karl A. Kurzius, 4246 Eubank, NE., Albuquerque, N. Mex. 87111

[21] Appl. No.: 179,343

[22] Filed: Aug. 18, 1980

[51] Int. Cl.[3] ..... A47J 47/16

[52] U.S. Cl. ..... 248/145.6; 215/100 A; D7/70

[58] Field of Search ..... 248/145.6; 220/96; 294/27 H; 224/50; 215/100 A; D7/70; 16/114 A

[56] References Cited

U.S. PATENT DOCUMENTS

| | | | |
|---|---|---|---|
| D. 149,933 | 6/1948 | Bushman | 248/146 UX |
| D. 233,118 | 10/1974 | Finn | D7/70 |
| D. 254,417 | 3/1980 | DeMars | D7/70 |
| 1,147,856 | 7/1915 | Gilchrist | 248/145.6 |
| 1,646,562 | 10/1927 | Snow | D7/70 X |
| 2,075,217 | 3/1937 | Milburn | 215/100 A |
| 2,215,411 | 9/1940 | Sebring | 294/27 H |
| 2,665,936 | 1/1954 | Moore | 16/114 A X |
| 2,801,743 | 8/1957 | Geen | 215/100 A X |
| 2,942,910 | 6/1960 | Bramming | 215/100 A X |
| 3,029,975 | 4/1962 | Aiello | D7/70 X |
| 3,317,232 | 5/1967 | McFaul | D7/70 X |

*Primary Examiner*—J. Franklin Foss
*Attorney, Agent, or Firm*—Richard A. Bachand

[57] ABSTRACT

A can holder having a base and a base support member that is connected to a handle member with a first and second clip means for clipping on each end of a food or beverage container is disclosed.

3 Claims, 3 Drawing Figures

CAN HOLDER

BACKGROUND OF THE INVENTION

This invention relates to holders for clipping on to cylindrical containers such as food or beverage cans.

Heretofore food and beverage containers had associated with them certain problems for the user of these containers, especially when the containers contained large quantities, such as sixteen ounces or more or were chilled or heated. In the case where the container is a large sixteen ounce container, due to its physical size, it is difficult for one to hold it for the purposes of pouring out the contents. This problem is even more manifested in the cases where the user has a physical deformality, such as arthritis, which makes gripping the large container very difficult. In the cases where chilled beverages are contained in the container, there is the problem of the container sweating during the process of the contents of the container being consumed.

SUMMARY OF THE INVENTION

A can holder having a base and a base support member that is connected to a handle member with a first and second clip means for clipping on each end of a food or beverage container is disclosed.

These are two versions of the container disclosed and one being for the container up to approximately sixteen ounces and the other being for the extremely large containers of sixteen ounces or more.

DETAILED DESCRIPTION OF THE PREFERRED EMBODIMENT

Figure 1:
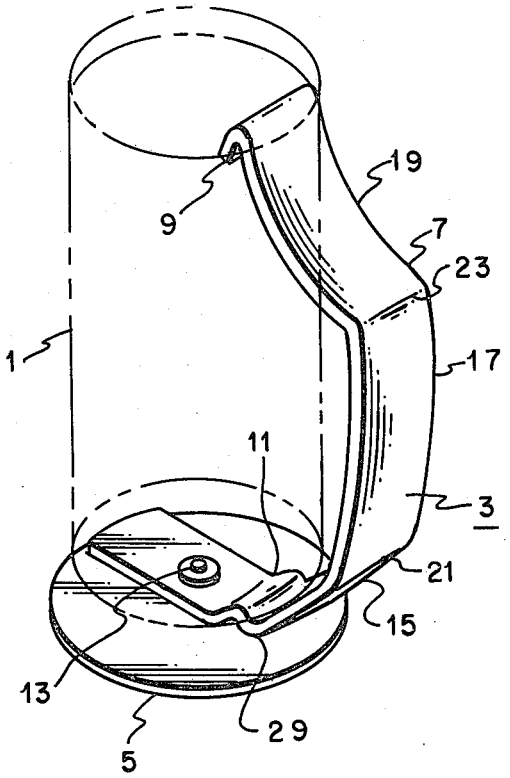
FIG. 1 is a combination view of a container with a handle according to the invention.

In FIG. 1, to which reference should now be made, there is shown a can 1 that is carried by a can holder 3. The can holder consists of a base plate 5 and a side support arm 7 that has a top clip 9 and a bottom clip 11. The can holder is affixed to the base plates by means of the rivet 13 and as shown, the clips 9 and 11 secure the can 1 to the can holder 3. There are three sections to the side support arms 15, 17 and 19 which are formed by bends 21 and 23. Section 15 is approximately $\frac{1}{3}$ of the length of the handle, section 17 is approximately 5/12 of the length of the handle and section 19 is approximately 3/12 of the length of the handle. The bends assist in shaping of the handle 7 and support is provided by the fact that the sections 15 and 17 have a convexed bend to them, that is, they bend away from the cylindrical container or can 1 whereas section 19 has a concave bend, that is, it bends toward the container 1.

Figure 2:
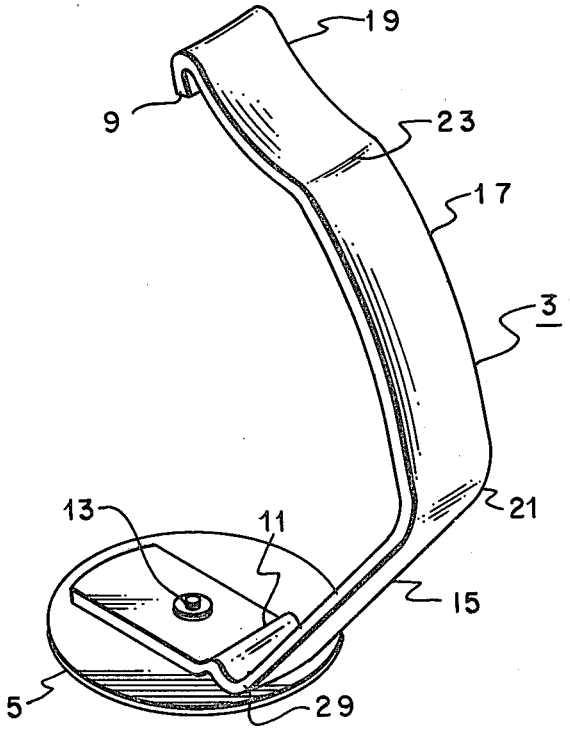
FIG. 2 is an isometric figure of one embodiment of the invention.

In FIG. 2, there is shown an unexpanded view of the can holder (the holder is expanded when mounted on a can) where the base plate 5 is again fixed to the side arm 7 by means of the rivet 13. The bends at points 15, 21 and 23 are again shown as well as the curvatures to sections 19, 17 and 15. In the view shown in FIG. 2, the side support arm 3 is shown contracted. Strength to the handle is achieved, as was discussed before, by the concave and convex bending of the material which the side support member 3 is manufactured from and also the bends 21 and 23 have a spring constant associated with them. When a can is clipped between the clip 9 and 11, the arm member 3 tries to contract back to the original shape shown in FIG. 2. Due to the fact that the material used springingly maintains its grasp to the can carried thereby, it has been found that the side arm support member can be made out of commercially available plastic materials.

Figure 3:
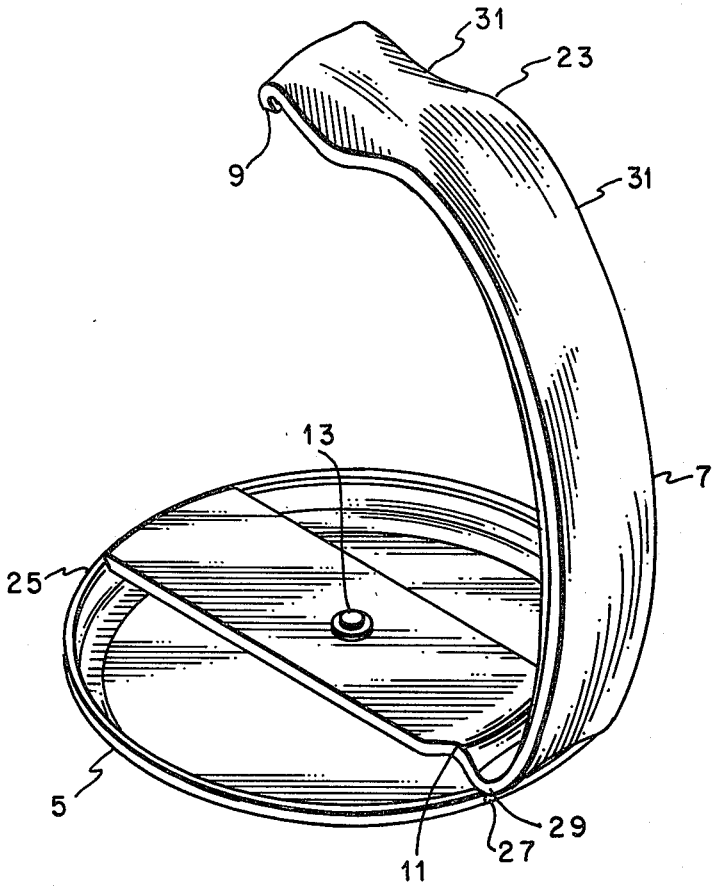
FIG. 3 is an isometric of another embodiment of the can holder according to the invention.

In FIG. 3, which is another embodiment of the invention of FIG. 1, there is shown a base plate 5 which has a lip 25 extending upward from the base plate, and the lip 25 is designed to fit snugly around the base of a container that would be attached to the handle 3. Again, as in the case of the previous two figures, there is a base lip 11 and a top lip 9 which when expanded latches a can or container to the base plate 5. The base plate again is secured to the side arm support member 7 by means of a rivet 13, as shown, or by other convenient fastening means (not shown).

In addition, there is a notch 27 in the base plate 5 that provides clearance for the handle 7. In the embodiment shown, a bend 23 is provided to the side handle 7 (see FIG. 3). The handle is shaped as an arc from the clearance of the base plate at notch 27 which is point 29 to the bend 23. The section 31 which is the arc of the handle between bend 29 to bend 23 has, in addition, a convex bend. That is, it bends away from the two clip means 9 and 11 whereas the section between bend 23 to the clip 9 has a concave bend to it. It bends in towards either the clip means or the base plate. It has been found that the shape of the handle shown in FIG. 3 lends itself more readily to the holding of the larger container such as the containers that contain, for example, sixteen ounces or more of food or beverages.

Many changes and modifications in the above described embodiment of the invention can, of course, be carried out without departing from the scope thereof. Accordingly, to promote the progress and science in useful arts, the invention is disclosed and is intended to be limited only by the scope of the appended claims.

I claim:

1. A holder for receiving and holding a can having a top and bottom ridge, comprising:

a round base support of diameter approximately at least as large as the diameter of the can to support the can in use, a single springable handle member carried upon said base support, said handle being formed of a single rectangular piece of plastic, a first transverse U-shaped bend in said handle member adjacent a distal end from said base to engage the top ridge of the can, a second transverse U-shaped bend in said handle member adjacent the base to engage the bottom ridge of the can, whereby said can is received in said holder between said first and second transverse bends, said handle being arcuately configured along its longitudinal axis to assume a normal configuration in which the first and second transverse bends are separated by a distance less than the height of the can, said handle being transversely arcuately configured along a substantial portion of its length to add a bias in the handle to urge it to the normal configuration to snugly retain the can received in the holder, a substantial portion of said handle extending across the base support, said extending portion being flat, free of arcuate biasing configurations.

2. The holder of claim 1 wherein said handle comprises first, second and third bends along the arcuate length of the handle, and wherein the portions of the handle between the respective first, second and third bends are oppositely arcuately configured.

3. The holder of claim 2 wherein the first, second and third bends are respectively adjacent, one-third the distance, and three-eighths of the distance, from said first transverse bend along the length of the handle to the second transverse bend.

* * * * *